United States Patent [19]

Treiber et al.

[11] 4,329,921

[45] May 18, 1982

[54] DAMPING DEVICE FOR AN ELECTROMAGNETICALLY DRIVEN PRINTING HAMMER

[75] Inventors: Dieter Treiber; Adam Kling; Ulrich Heider, all of Munich, Fed. Rep. of Germany

[73] Assignee: Siemens Aktiengesellschaft, Berlin & Munich, Fed. Rep. of Germany

[21] Appl. No.: 153,742

[22] Filed: May 27, 1980

[30] Foreign Application Priority Data

Aug. 20, 1979 [DE] Fed. Rep. of Germany ..... 2933616

[51] Int. Cl.[3] ..... B41J 9/42

[52] U.S. Cl. ..... 101/93.02; 100/167

[58] Field of Search ..... 101/93.02, 93.29–93.34, 101/93.48; 400/167; 335/277, 253, 271

[56] References Cited

U.S. PATENT DOCUMENTS

| | | | |
|---|---|---|---|
| 2,204,187 | 6/1940 | Ostler | 101/93.02 |
| 3,755,700 | 8/1973 | Buschmann et al. | 310/30 |
| 3,804,009 | 4/1974 | Blume | 101/93.02 X |
| 4,018,154 | 4/1977 | Matsumoto et al. | 101/93.02 |
| 4,062,285 | 12/1977 | Deetz et al. | 101/93.02 |

FOREIGN PATENT DOCUMENTS

| | | | |
|---|---|---|---|
| 1761651 | 7/1971 | Fed. Rep. of Germany . | |
| 2238605 | 2/1974 | Fed. Rep. of Germany | 101/93.02 |
| 674812 | 7/1952 | United Kingdom | 101/93.02 |

OTHER PUBLICATIONS

Mathews, IBM Tech. Discl. Bulletin, vol. 19, No. 9, Feb. 1977, pp. 3245–3246.

*Primary Examiner*—Edward M. Coven

*Attorney, Agent, or Firm*—Hill, Van Santen, Steadman, Chiara & Simpson

[57] ABSTRACT

A damping device for a printing hammer which is driven by an electromagnetically actuated pivotable armature has a circuit associated therewith for operating the electromagnetic coils which generates a high excitation current for rapid acceleration of the armature and printing hammer which is followed by a switch over to a considerably lower holding current which maintains the armature in a position to abut the printing hammer during its return stroke. The armature also actuates a rotatable angle lever into engagement with the printing hammer for frictional braking thereof so that the hammer is rapidly damped to a rest position and is ready for a subsequent printing stroke.

7 Claims, 4 Drawing Figures

DAMPING DEVICE FOR AN ELECTROMAGNETICALLY DRIVEN PRINTING HAMMER

BACKGROUND OF THE INVENTION

1. Field of the Invention

The present invention relates to a damping device for an electromagnetically driven printing hammer, and in particular to such a hammer which is accelerated by an electromagnetically actuated pivotable armature.

2. Description of the Prior Art

Teleprinters and other printing devices of recent construction generally utilize a plurality of character-bearing type discs which are actuated by a printing hammer. A number of structures and methods for driving the printing hammers are known in the art, however, a design goal common to all is that the printing hammer, which returns to a starting position following a printing stroke, comes to a rest in the starting position in the shortest amount of time possible so that the hammer can immediately commence the next printing stroke. It is thus necessary to remove the kinetic energy from the printing hammer within the shortest possible time after a printing stroke has occurred. A device for suddenly stopping rapidly moving masses in mechanical printers is disclosed in German OS No. 17 61 651 wherein a buffer is provided against which the mass which is to be stopped strikes. The buffer is coupled by a support consisting of damping material to a stationary frame in such a manner that the buffer can pivot around the rest position of the suppport, and moreover the buffer is dimensioned such that it largely absorbs the kinetic energy of the mass. The structure required to realize a device of this type is relatively elaborate, and is therefore not practical for use with printing hammer actuating devices of the type initially described utilizing an electromagnetically controlled actuator to accelerate the printing hammer.

A further damping structure is known from German OS No. 21 19 415 corresponding to U.S. Pat. No. 3,755,700 in which a disc comprised of shock absorbing material is utilized which is seated on a threaded pin so that the range of motion of the printing element, which is in this case a printing needle, can be adjusted. Damping achieved by this structure is not sufficient at modern printing speeds in order to rapidly bring the printing element to a rest position to ready the element for a next printing stroke, and moreover, the damping ability of the material is substantially minimized at increased temperatures and is subject to significant deterioration during aging.

SUMMARY OF THE INVENTION

It is an object of the present invention to provide a damping device for an electromagnetic printing hammer drive means which includes an electromagnetically actuated armature with the damping device employing the electromagnetic actuating coils in order to damp the printing hammer.

The above object is inventively achieved in a structure having a pivotable electromagnetically actuated armature which abuts a spring biased printing hammer with the electromagnetic coils connected to a circuit which provides a momentary high current output, the so called excitation current, to rapidly accelerate the armature and printing hammer which is followed by a switch over to a substantially lower holding current which retains the armature in a position to abut the printing hammer upon its return stroke and which also actuates an additional stop means for frictional braking of the hammer.

The magnitude of duration of the holding current is selected such that at the time the printing hammer returns approximately to its rest position the armature is released from the magnetic coils so that the armature strikes against the stop means.

In one embodiment of the invention, the stop means consists of a pivotally mounted angle lever which is provided with a stop surface. One arm of the angle lever is located within the range of movement of the armature and the other arm of the angle lever, which is provided with an abutment surface for engagement with the printing hammer, comes into contact with the printing hammer as a friction brake when the lever is pivoted as a result of engagement with the armature.

The combination of the known mechanical impact principal which serves to absorb the kinetic energy of the printing hammer when it returns to the rest position, together with the electrical drive circuit disclosed herein for the magnetic coil, and the stop means functioning as a friction brake, results in the printing hammer coming to rest extremely rapidly following a printing stroke. In comparison to conventional printing hammer structures, a substantial increase in printing speed is thereby derived.

DESCRIPTION OF THE PREFERRED EMBODIMENTS

Figure 1:
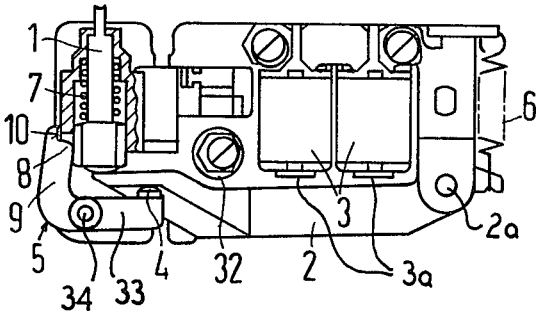
FIG. 1 is a plan elevational view of a printing hammer actuating structure constructed in accordance with the principles of the present invention.

A structure for actuating a printing hammer in a teleprinting or other printing device is shown in FIG. 1 wherein that portion of the printing hammer received in the actuating device is referenced at 1. An armature 2, rotatable about a pivot 2*a*, normally engages a lower portion of the printing hammer 1 in a rest position. The armature 2 operates against the action of a return spring 6, normally urging the armature 2 into the rest position shown in FIG. 1, and the printing hammer 1 operates against the action of a bias spring 7, also urging the printing hammer 1 into the rest position shown in FIG. 1.

The armature 2 is actuated by a pair of electromagnetic coils 3, each having a pole-piece 3*a* which magnetically attracts the armature 2 toward the coils 3 until the armature 2 abuts either the pole pieces 3*a* or an adjustable stop 32. The printing hammer 1 is simultaneously moved in conjunction with the armature 2 and when the armature 2 strikes against the pole surfaces 3*a* or the adjustable stop 32, the printing hammer 1 continues to move as a result of its inertia so that the printing hammer 1 is no longer in contact with the armature 2 and carries out the actual printing of a character by striking against a particular portion of a type wheel (not shown).

The bias spring 7 in combination with the elastic rebound of the type urges the printing hammer 1 back toward the rest position shown in FIG. 1.

By the operation of the circuit shown in FIG. 2, described in greater detail below, when the printing hammer 1 moves out of contact with the armature 2, the relatively high excitation current formerly present in the magnetic coil is switched to a holding current. The excitation current is graphically illustrated in FIG. 3 as JER, and the holding current is designated as JH. The holding current JH is dimensioned so that it overcomes the action of the return spring 6 and maintains the armature 2 against the pole pieces 3*a* of the magnetic coils 3. When the printing hammer 1 now returns to its rest position, the hammer 1 strikes against the armature 2 and overcomes the attraction of the armature 2 with the pole pieces 3*a* and thereby transfers a specific proportion of its kinetic energy to the armature 2 in such a manner that although the armature 2 returns to the rest position together with the printing hammer 1, the armature 2 reaches a stop surface 4 carried on an angle lever 5 before the printing hammer 1 reaches such a position. The printing hammer 1 never directly reaches the stop surface 4, but only a rest position which is determined by the stop surface 4 and the armature 2.

The stop surface 4 is disposed at an end of an arm 33 of the angle lever 5, with the lever 5 being rotatable about a pivot 34. A second arm 9 of the lever 5, disposed generally at a right angle to the arm 33, carries a frictional abutment surface 8 which is moved into engagement with the printing hammer 1 when the armature 2 strikes the stop surface 4. The surface 8 serves to frictionally brake the movement of the printing hammer 1, thereby further enhancing the damping effect.

A second stop surface 10 also carried on the arm 9 of the lever 5 limits the range of rotational movement of the lever 5 by abutting a stationary portion of the armature structure.

Figure 2:
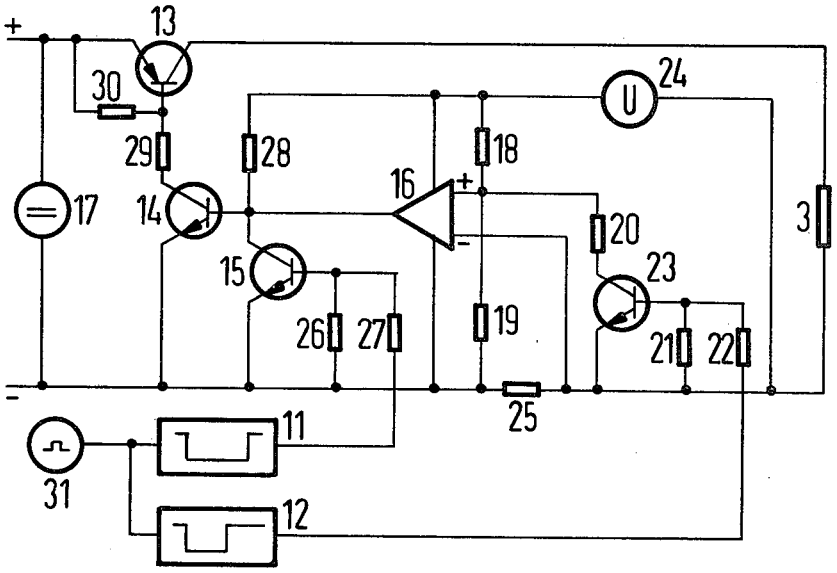
FIG. 2 is a circuit diagram of a circuit for operating the electromagnetic coils shown in FIG. 1.

The above described sequence is achieved by the use of the circuit illustrated in FIG. 2 which includes two monostable trigger stages 11 and 12 which control the timing of the operation of the circuit and damping device. Three switching transistors 13, 14 and 15 connect the electromagnetic coils 3 to a constant voltage source 17. The switching transistors 13, 14 and 15 are in a conducting or non-conducting state depending upon the output signal of an amplifier 16 which regulates the excitation current JER and the holding current JH. The amplifier 16, which is connected as a current regulator, is connected at its positive input to a voltage divider arrangement consisting of resistors 18, 19, 20, 21 and 22 and to a fourth switching transistor 23. In accordance with the required current in the electromagnetic coil 3, the switching transistor 23 which is driven by the trigger stage 12, modifies the dividing ratio of the voltage divider which is connected to a reference voltage 24 through the resistor 18. The negative input of the amplifier 16 is connected to a measuring resistor 25 which serves to establish the actual value of the current in the electromagnetic coils 3. The additional resistors 26, 27, 28, 29 and 30 serve in a known manner to match the switching transistors.

Figure 3:
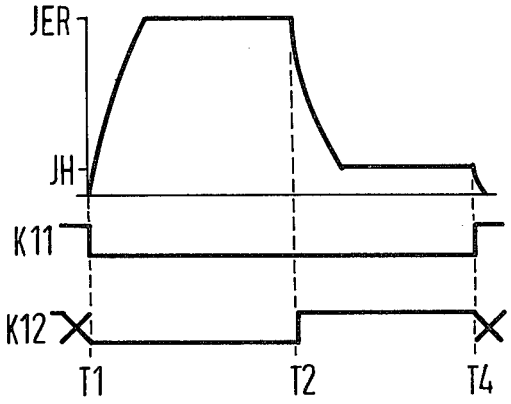
FIG. 3 is a graphic illustration of the electromagnetic coil current together with controlling switching pulses.

A detailed operation of the circuit shown in FIG. 2 is explained as follows with reference to the current-time diagram of FIG. 3 and the displacement-time diagram of FIG. 4.

At a time T1 the monostable trigger stages 11 and 12 are set by means of a start pulse which is applied at an input 31 shown in FIG. 2. The trigger stage 11 produces a pulse as shown in FIG. 3 at K11 which opens the switching transistor 13 through the transistors 15 and 14 so that coils 3 are connected to the voltage source 17. The current in the coils 3 rapidly rises to the value of the excitation current JER. The influence of the magnetic field produced thereby moves the armature 2 toward the pole-pieces 3*a* and the printing hammer 1 is correspondingly moved to begin a printing stroke. At a subsequent time T2, the armature 2 strikes against either the pole pieces 3*a* or against the stop 32 so that the printing hammer 1 is released from contact with the armature 2 as a result of its own inertia. At this time, the monostable trigger stage 12 is triggered as shown in the curve K12 in FIG. 3, and a switch over results to the holding current JH.

The printing hammer 1 which then rebounds from a printing position is returning to the rest position and strikes against the armature 2 at a time T3 and thereby exerts a kinetic energy transferring impact on the armature 2. This impact is sufficient to overcome the magnetic attraction exerted on the armature 2 by the holding current so that the armature 2 is released from contact with the pole-pieces 3*a* and at a time T4 strikes against the stops surface 4. The printing hammer 1 is further decelerated by the action of the angle lever 5 which is rotated about the pivot 34 when the armature 2 strikes the stop surface 4 and frictionally engages the printing hammer 1 at the abutment surface 8.

At approximately this moment, the holding current JH is disconnected when the monostable trigger element 11 returns to its initial state. The armature 2 is at this moment in effect "bouncing" on the stop surface 4 and again strikes against the printing hammer 1 at a time T5, as a result of which the printing hammer is further decelerated such that at a time T6 both the armature 2 and the printing hammer 1 have reassumed their respective starting positions and are at rest.

Figure 4:
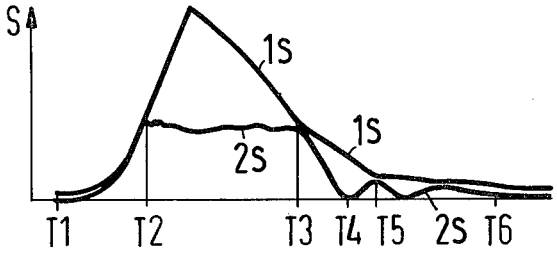
FIG. 4 is a graphic illustration of the displacement of the printing hammer and the armature during a printing operation of the structure of FIG. 1.

The displacement path of the printing hammer 1 and the armature 2 are graphically illustrated in FIG. 4 with the vertical axis S representing a displacement distance. The curve representing the movement of the printing hammer 1 is shown at 1S, and the displacement path of the armature 2 is represented by the curve designated 2S.

In order to achieve a movement sequence of the type described above, the mass inertial moments of the printing hammer 1 and the armature 2 should be matched to one another in a ratio of approximately 2 to 1. A structure operational in the manner described above may, for example, exhibit the following values. The moment of inertia of the printing hammer may be 140 g.cm$^2$, the moment of inertia of the armature 2 may be 72 g.cm$^2$, the mass of the printing of the printing hammer may be 4.2 g, the distance of the printing hammer from the axis of rotation of the armature lever may be 58 mm, the length of the armature 2 may be 65 mm, the mass of the armature lever may be 12 g, the maximum path length of the portion of the hammer abutting the armature may be 7 mm with a maximum path length out of contact with the armature being 2.5 mm. The maximum excitation current may be 2 amperes and a maximum holding current may be 0.3 amperes.

In addition to the movement sequence described above, it will be apparent to those skilled in the art that various other movement sequences are possible by appropriate dimensioning of the currents. Thus, for example, the magnitude of the holding current may be selected such that although the returning printing hammer 1 releases the armature 2 from contact with the pole pieces 3*a*, before the armature 2 reaches the stop surface 4 the magnetic attraction from the pole pieces 3*a* is sufficient to pull the armature 2 again toward the pole pieces 3*a* before reaching the stop surface 4. In such operation, the moments of inertia of the printing hammer 1 and the armature 2 must be adapted to one another such that after a small number of impacts the printing hammer 1 and the armature 2 together reach the stop surface 4 at a low speed. When the stop surface 4 is finally reached, the holding current is then disconnected.

Although other modifications and changes may be suggested by those skilled in the art, it is the intention of the inventors to embody within the patent warranted hereon all changes and modifications as reasonably and properly come within the scope of their contribution to the art.

We claim as our invention:

1. In a system for actuating a printing hammer including at least one electromagnetic coil and a pivotable armature engageable with said printing hammer and magnetically attractable to said coil, said armature and said printing hammer being normally urged to a rest position by respective first and second bias springs, a device for damping said printing hammer during a return stroke after a printing stroke comprising:

a rotatably mounted angle lever carrying a stop surface on a first arm thereof, said stop surface disposed in the movement range of said armature for limiting movement of said armature and said printing hammer during said return stroke and absorbing kinetic energy therefrom, said lever being rotated by said armature during said return stroke, said lever having a second arm disposed substantially perpendicularly to said first arm having a frictional abutment surface which is moved into engagement with said printing hammer for frictional braking thereof as said lever is rotated by engaging said armature during said return stroke; and a circuit for operating said coil providing a momentary excitation current for rapidly moving said first arm toward said coil against the force of said first bias spring and accelerating said printing hammer against the force of said second bias spring away from contact with said armature, and switching to a holding current substantially lower than said excitation current for maintaining said armature against said coil for abutting said printing hammer during said return stroke.

2. The damping device of claim 1 wherein the magnitude and duration of said holding current are selected such that said armature is released from contact with said magnetic coil upon said printing hammer abutting said armature and is forced against said stop surface by said printing hammer during a return stroke.

3. The damping device of claim 1 wherein said holding current has a magnitude selected such that said armature is released from contact with said coil upon abutting said printing hammer during a return stroke and is returned to contact with said coil before abutting said stop surface.

4. The damping device of claim 1 wherein said second arm of said angle lever carries an additional stop surface for limiting the rotation of said angle lever, said additional stop surface abutting a stationary element when said system is in a rest state.

5. The damping device of claim 1 wherein the moment of inertia of said printing hammer is substantially two times the moment of inertia of said armature.

6. The damping device of claim 1 wherein said circuit comprises:

a current-regulating amplifier having a positive input and a negative input and an output;

a measuring resistor connected between said negative input of said amplifier and said coil;

a voltage divider connected to a reference potential and to said positive input of said amplifier for determining the values of said excitation current and said holding current;

a switching transistor connected to said voltage divider for selectively supplying said excitation current or said holding current to said positive input of said amplifier;

at least one additional switching transistor controlled by the output of said amplifier and connected between said coil and a constant voltage source; and a means connected to said switching transistors for sequentially switching said transistors for initially generating said excitation current and subsequently generating said holding current.

7. The circuit of claim 6 wherein said means for selectively switching said transistors is a pair of monostable trigger stages cooperatively dimensioned with respect to time with the movement of said printing hammer.

* * * * *